US005421662A

United States Patent [19]

Magee

[11] Patent Number: 5,421,662

[45] Date of Patent: Jun. 6, 1995

[54] STABILIZATION SYSTEM FOR THE PRINTING OF SIGNATURES

[75] Inventor: Lawrence D. Magee, Bolingbrook, Ill.

[73] Assignee: R. R. Donnelley & Sons Company, Lisle, Ill.

[21] Appl. No.: 263,756

[22] Filed: Jun. 22, 1994

[51] Int. Cl.[6] ..... B65H 39/02

[52] U.S. Cl. ..... 270/1.1; 270/54; 270/58

[58] Field of Search ..... 270/1.1, 15, 54, 58; 271/198, 199, 216, 218; 400/634, 635, 686, 629

[56] References Cited

U.S. PATENT DOCUMENTS

| | | | |
|---|---|---|---|
| 3,617,055 | 11/1971 | Stal | 271/218 |
| 3,812,779 | 5/1974 | Cobb | 101/115 |
| 3,819,173 | 6/1974 | Anderson | 270/54 |
| 3,998,141 | 12/1976 | Hsiue | 271/202 |
| 4,109,779 | 8/1978 | Bauer et al. | 400/635 |
| 4,121,818 | 10/1978 | Riley et al. | 270/54 |
| 4,588,180 | 5/1986 | Ballestrazzi et al. | 271/209 |
| 4,747,817 | 5/1988 | Newsome | 271/216 |
| 4,771,687 | 9/1988 | Daunheimer | 101/44 |
| 4,897,017 | 1/1990 | Castiglioni | 271/218 |
| 4,934,687 | 6/1990 | Hayden et al. | 271/202 |
| 4,953,459 | 9/1990 | Ericsson | 101/115 |
| 5,017,028 | 5/1991 | Harding . | |
| 5,067,699 | 11/1991 | Gadway et al. | 270/1.1 |
| 5,203,549 | 4/1993 | Bryson, Sr. et al. | 270/1.1 |
| 5,314,176 | 5/1994 | Schmitt | 270/1.1 |

*Primary Examiner*—Eugene H. Eickholt

*Attorney, Agent, or Firm*—Marshall, O'Toole, Gerstein, Murray & Borun

[57] ABSTRACT

A stabilization system for the printing of signatures having a chain conveyor for conveying a plurality of signatures in a longitudinal direction, the chain conveyor being subdivided into a plurality of conveyor spaces and one of the signatures being provided in each of the conveyor spaces. The stabilization system includes a support structure for supporting the chain conveyor, means for lifting the signatures off of the chain conveyor, and a second conveyor for conveying the signatures in the longitudinal direction to a printer for printing textual subject matter on the signatures after they are lifted from the chain conveyor. The second conveyor has a support structure that is separate and vibrationally isolated from the chain conveyor and the support structure for the chain conveyor so that the printer is separate and vibrationally isolated from the chain conveyor and its support structure.

14 Claims, 2 Drawing Sheets

STABILIZATION SYSTEM FOR THE PRINTING OF SIGNATURES

BACKGROUND OF THE INVENTION

The present invention is directed to a stabilization system for the printing of signatures to prevent shock and vibrations generated from the conveyance of the signatures from adversely affecting the quality of the printing on the signatures.

Signatures of which books or magazines are composed may be conveyed by a conveyance system in order to accomplish a variety of functions, one of which includes the application of printing to the signatures. One problem with such a system is that vibrations generated by the conveyance system may cause the printing to be blurred or otherwise adversely affected. In some relatively forgiving applications, such as the printing of a name and address within a white box on a magazine cover, slight blurring of the printing may be acceptable as long as the printing is legible. However, in applications with more stringent printing requirements, such as the printing of the interior pages of a book or magazine, such blurring is unacceptable.

U.S. Pat. No. 4,121,818 to Riley, et al. discloses a signature collating and binding system in which various printing operations are performed on signatures which are conveyed by a chain conveyor. As shown in FIGS. 4A and 4B, a number of signatures 34 are conveyed by a pair of spaced chains 90 past a label printer 94 composed of a number of individual print heads 56. In FIG. 3, a number of signatures 34 are conveyed by a collating chain 44 past a signature printer 54 composed of five printheads 56 so that five lines of printing may be printed within a one-inch width. There is no disclosure in the Riley, et al. patent that the printing operations are completely shielded from vibrations generated by the signature conveyors.

SUMMARY OF THE INVENTION

The present invention is directed to a stabilization system for the printing of signatures in which the printer is vibrationally isolated from the signature conveyance system so that vibrations generated by the conveyance system do not adversely affect the quality of the printing on the signatures.

The stabilization system includes a first conveyor means for conveying a plurality of signatures in a longitudinal direction and which is subdivided into a plurality of conveyor spaces, one of the signatures being provided in each of the conveyor spaces. The first conveyor means has a support structure for supporting it. The stabilization system also includes lifting means for lifting the signatures off of the first conveyor means, second conveyor means for conveying the signatures in the longitudinal direction, and second support means for supporting the second conveyor means which is separate and vibrationally isolated from the first conveyor means and the first support means, and printing means for printing textual subject matter on the signatures after the signatures are lifted from the first conveyor means. The printing means is separate and vibrationally isolated from the first conveyor means and the first support means.

The first conveyor means of the stabilization system may comprise a chain having a plurality of spaced lugs, with the spaces between adjacent lugs defining the conveyor spaces. The second conveyor means may comprise a first pair of conveyor belts spaced apart in a direction transverse to the longitudinal direction in which the signatures are conveyed and provided in contact with an upper surface of one of the signatures and a second pair of conveyor belts spaced apart in a direction transverse to the longitudinal direction and provided in contact with a lower surface of one of the signatures.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
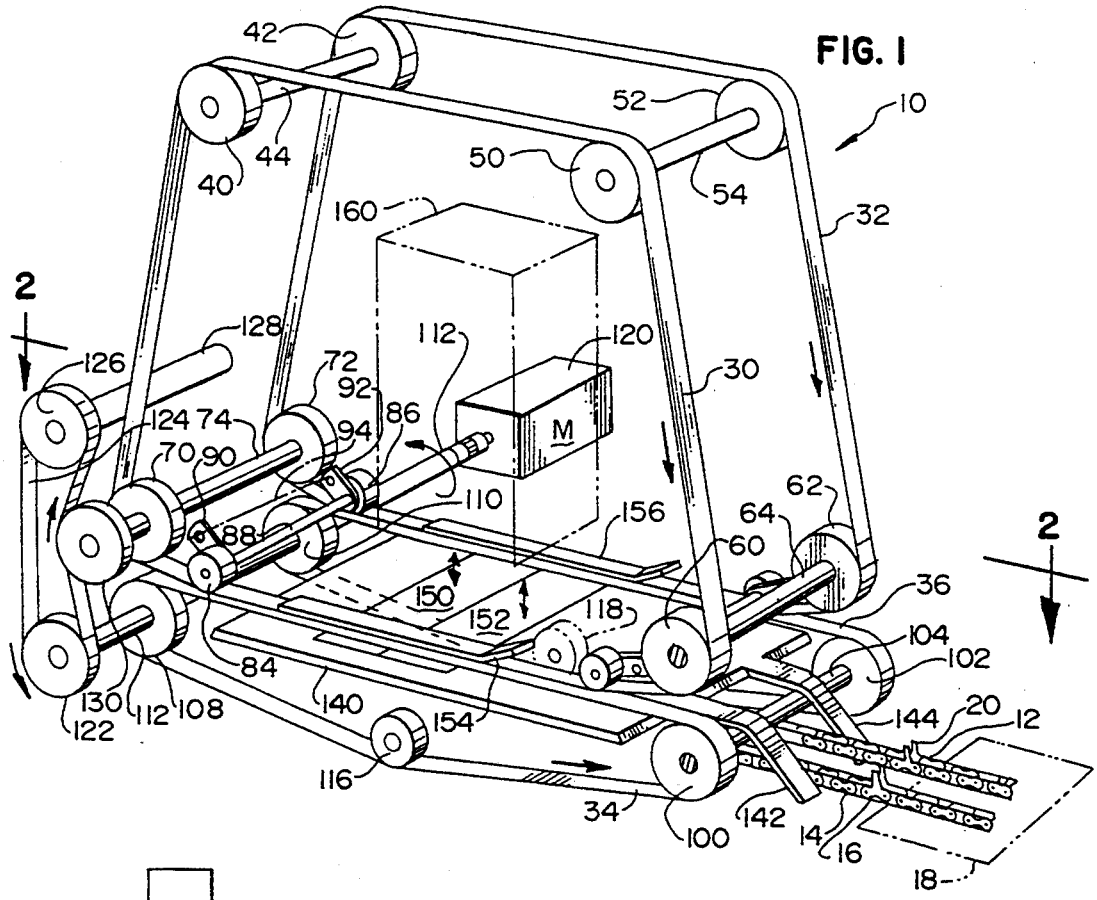
FIG. 1 is a perspective view of a preferred embodiment of a stabilization system in accordance with the invention with a number of components omitted for sake of clarity.

FIG. 1 illustrates a preferred embodiment of a stabilization system 10 for the printing of signatures. The stabilization system 10 includes a first signature conveyance system in the form of a pair of chains 12, 14 each of which has a plurality of spaced lugs 16 provided therein to define a plurality of conveyor spaces in which a plurality of signatures 18 may be conveyed. Each of the spaced lugs 16 has a vertical projection 20 which pushes an edge of a signature 18 to maintain the signature within its respective conveyor space. The chains 12, 14 of the first conveyor system move from right to left as indicated in FIG. 1 by the arrow.

The stabilization system 10 includes a second signature conveyance system which includes a pair of upper conveyor belts 30, 32 and a pair of lower conveyor belts 34, 36. The upper conveyor belts 30, 32 are supported by a first upper roller assembly comprising a pair of rollers 40, 42 mounted for rotation on a fixed shaft 44 and a second upper roller assembly comprising a pair of rollers 50, 52 mounted for rotation on a fixed shaft 54. The upper conveyor belts 30, 32 are supported by a first lower roller assembly comprising a pair of rollers 60, 62 mounted for rotation on a fixed shaft 64 and by a second lower roller assembly comprising a pair of rollers 70, 72 fixed to a rotatable shaft 74. The two ends of each of the four shafts 44, 54, 64, 74 may extend into and be supported by a pair of vertical support members 80, 82 (shown in FIGS. 2 and 4) of a support frame for the second conveyor system.

Slack in the conveyor belts 30, 32 is reduced by a first takeup assembly comprising a pair of rollers 84, 86 connected to a shaft 88. A pair of spring-biased arms 90, 92 each have a first end connected to the shaft 88 and a second end which may pivot about an axis 94. The arms 90, 92 are spring-biased to force the rollers 84, 86 downwardly so that excess slack in the belts 30, 32 is taken up. A similar takeup assembly is provided for the belts 30, 32 adjacent the rollers 60, 62.

The lower conveyor belts 34, 36 are supported by a first roller assembly comprising a pair of rollers 100, 102 mounted for rotation on a fixed shaft 104 and by a second roller assembly comprising a pair of rollers 108, 110 fixed to a rotatable drive shaft 112. The two ends of each of the shafts 104, 112 may extend into and be supported by the vertical housing members 80, 82 (shown in FIGS. 2 and 4). Excess slack in the lower conveyor belts 34, 36 is taken up by a pair of takeup rollers 116, 118.

The drive shaft 112 is rotatably driven by a motor 120, causing the belts 34, 36 to be driven in the direction indicated by the arrow. The drive shaft 112 is connected to a roller 122 on which a belt 124 is provided. The belt 124 is supported by a second roller 126 mounted on a shaft 128, and a third roller 130 mounted on the shaft 74 makes contact with and is driven by the belt 124.

In operation, the motor 120 drives the shaft 112 in a counterclockwise direction, as indicated by the arrow, which causes the rollers 108, 110 to rotate counterclockwise, driving the lower belts 34, 36 in a counterclockwise direction. The counterclockwise rotation of the shaft 112 also causes the roller 122 and the belt 124 to rotate in a counterclockwise direction. The belt 124, which is in contact with the roller 130, causes the roller 130 to rotate in a clockwise direction. Since the roller 130 is fixed to the shaft 74, the shaft 74 and the rollers 70, 72 fixed to it rotate in a clockwise direction and cause the belts 30, 32 to move in a clockwise direction. Since the rollers 70, 72, 108, 110, 122, 126, 128 all have the same diameter, the upper belts 30, 32 move at the same speed as the lower belts 34, 36.

A horizontal support plate 140 is disposed just below the lower belts 34, 36. A pair of signature-lifting arms 142, 144 formed integrally with the support plate 140 extend downwardly to an extent below the upper surface of the chains 12, 14 on which the signatures 18 are carried. As the chains 12, 14 move past, the lifting arms 142, 144 lift the signatures 18 off of the chains 12, 14 and onto the support plate 140 as described in more detail below.

A rectangular aperture is formed in the support plate 140, and a pair of vertically movable plates 150, 152 are disposed within the aperture. A pair of belt guides 154, 156 are disposed on either side of the plates 150, 152 directly above the upper conveyor belts 30, 32. A printer fixture or enclosure 160, shown in dotted lines, is disposed above the movable plates 150, 152.

Figure 2:
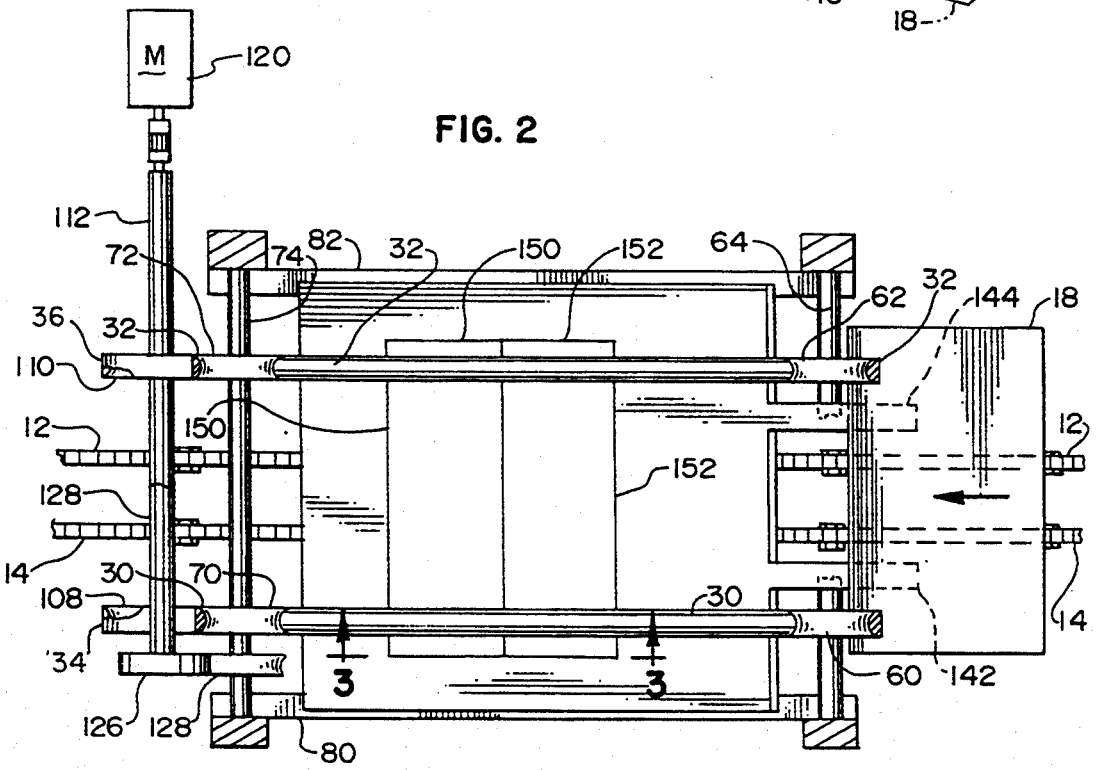
FIG. 2 is a cross-sectional view of a portion of the stabilization system of FIG. 1 taken along the lines 2—2 in FIG. 1.

A cross-sectional view of the stabilization system 10 taken along lines 2—2 of FIG. 1 is shown in FIG. 2. For purposes of simplicity, a number of components are omitted from FIG. 2, including the printer enclosure 160, the belt guides 154, 156, and the two takeup assemblies for the upper belts 30, 32. Also, the signature 18 in FIG. 2 is shown in an advanced position, with respect to its position shown in FIG. 1, in which it has been partially lifted from the chains 12, 14 by the lifting arms 142, 144.

Figure 4:
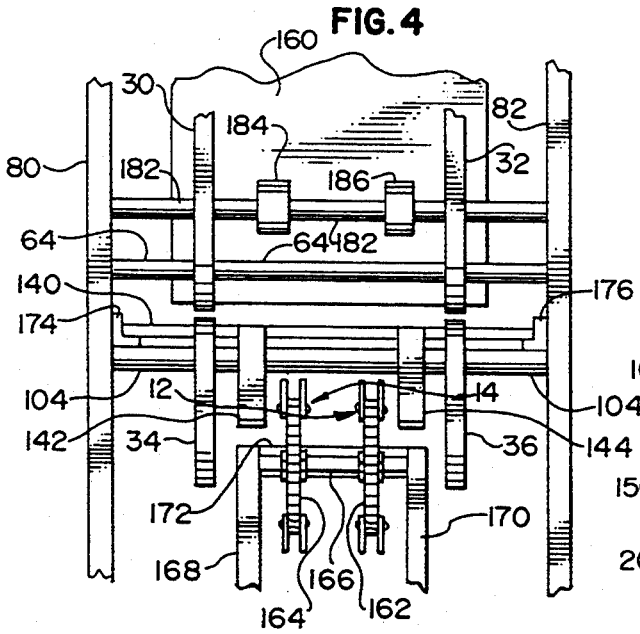
FIG. 4 is an elevational view of a portion of the stabilization system.

FIG. 4 is a side elevational view of a portion of the stabilization system 10, from which a number of components have been omitted for purposes of simplicity, which illustrates the isolation between the first conveyor system composed of the chains 12, 14 and the second conveyor system composed of the conveyor belts 30, 32, 34, 36.

Referring to FIG. 4, the chains 12, 14 of the first conveyor system are supported and driven by a pair of sprockets 162, 164, respectively, which are connected to a shaft 166. The sprockets 162, 164 may be fixed to the shaft 166 and the shaft 166 may be rotatably driven in a conventional manner, such as by a motor (not shown) connected to an extension of the shaft 166. Other means for driving the chains 12, 14 could be utilized. The shaft 166 is supported by a support structure or table comprising a pair of vertical members 168, 170 and a horizontal member 172. The vertical members 168, 170 are supported by the ground or floor of the room in which the stabilization system 10 is provided.

The second conveyor system in the form of the conveyor belts 30, 32, 34, 36, the support plate 140, and the printer enclosure 160 are supported by a separate support structure or table comprising the vertical support members 80, 82, which are themselves supported by the ground or floor of the room in which the stabilization system 10 is provided. As shown in FIG. 4, the upper conveyor belts 30, 32 are supported by the shaft 64 (which supports the rollers 60, 62 as shown in FIG. 1) which is mounted to the vertical support members 80, 82, and the lower conveyor belts 34, 36 are supported by the shaft 104 (which supports the rollers 100, 102 as shown in FIG. 1) which is mounted to the vertical support members 80, 82. The support plate 140 and the lifting arms 142, 144 integrally formed therewith are mounted to the support members 80, 82 via a pair of L-shaped brackets 174, 176.

Figure 3:
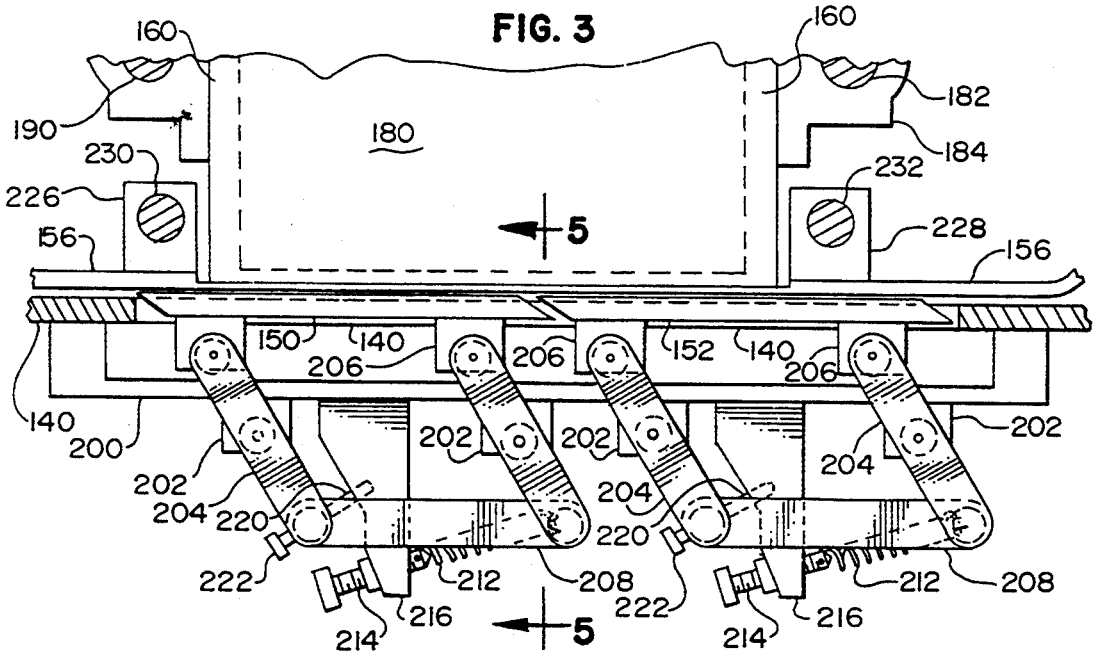
FIG. 3 is a cross-sectional view of a portion of the stabilization system taken along lines 3—3 in FIG. 2 with a number of components omitted for sake of clarity.

The printer enclosure 160, which may be a metal housing which encloses and supports a printer 180 (shown in FIGS. 3 and 5) in a conventional manner, is mounted to the support members 80, 82 via a rod 182 which passes through a pair of mounting brackets 184, 186 connected to the printer enclosure 160. Alternatively, the rod 182 could be connected to a pair of mounting brackets (not shown) fixed to the top of the support plate 140. The other side of the printer enclosure 160 has a second pair of support brackets (one of which is shown in FIG. 3) through which a second support rod 190 (shown in FIG. 3) passes. The second support rod 190 may also be connected to the support members 80, 82.

The position of the printer enclosure 160, and thus that of the printer 180 contained therein, can be adjusted with respect to a signature 18 by sliding the printer enclosure 160 along the rods 182, 190. After the printer enclosure 160 is positioned as desired, it can be fixed in place in any conventional manner, such as by tightening retention screws (not shown) threaded into the mounting brackets 184, 186 so that the retention screws make contact with the rod 182. The printer 180 is a conventional, letter-quality printer of the type suitable for the printing of the interior pages of books and magazines.

There is no mechanical interconnection between the first conveyor system, which comprises the chains 12, 14, the shaft 166, and the members 168, 170, 172, and all of the remaining components of the stabilization system 10, which include the second conveyor system, the printer enclosure 160 and associated components, and the support plate 140 and its associated lifting arms 142, 144. As a result, any vibration generated by the operation of the chains 12, 14 is completely isolated from the remaining components of the stabilization system and does not adversely affect the printing of textual subject matter by the printer 180 contained in the enclosure 160.

FIG. 3 illustrates the structure for supporting the upwardly biased plates 150, 152 (the conveyor belts 30, 32, 34, 36 and the chains 12, 14 have been omitted from FIG. 3 for sake of clarity). Referring to FIG. 3, a generally horizontal mounting plate 200 is secured to the underside of the support plate 140. A plurality of mounting brackets 202 are connected to the underside of the mounting plate 200. An arm 204 is pivotally connected to each of the mounting brackets 202. The upper end of each of the pivotal arms 204 is pivotally connected to one of the plates 150, 152 via a respective mounting bracket 206. The lower end of each of the pivotal arms 204 is pivotally connected to a respective end of one of a number of horizontal bars 208 so that the pivotal arms 204 in the structure supporting each of the plates 150, 152 are always maintained in parallel.

The pivotal arms 204 are spring-biased to pivot in a clockwise direction, and thus to force the plates 150, 152 upwards, by a number of springs 212, each of which is connected between a bottom end of one of the pivotal arms 204 and an adjustment screw 214 threaded into a mounting member 216 connected to the underside of the mounting plate 200. The amount of force generated by each of the springs 212, and thus the amount of upward force generated on each of the plates 150, 152, can be adjusted by turning the adjustment screws 214.

A mechanical stop may optionally be provided to prevent the plates 150, 152 from moving downwardly by more than a predetermined amount. Such a mechanical stop is provided in the form of a pair of bolts 220 each of which is threaded into the mounting brackets 216. Each bolt has a head 222 which abuts one of the pivotal arms 204 when one of the plates 150, 152 moves downward by a predetermined amount to prevent further downward movement of the plate. Such a mechanical stop is not considered important to the invention, and if used, it could be implemented in other ways.

Still referring to FIG. 3, each belt guide 156 has a pair of upwardly extending portions 226, 228 each of which is supported by one of a pair of rods 230, 232. The rods 230, 232 may be connected to the vertical support members 80, 82 (FIG. 4), or alternatively, to mounting brackets (not shown) connected to the upper surface of the support plate 140.

Figure 5:
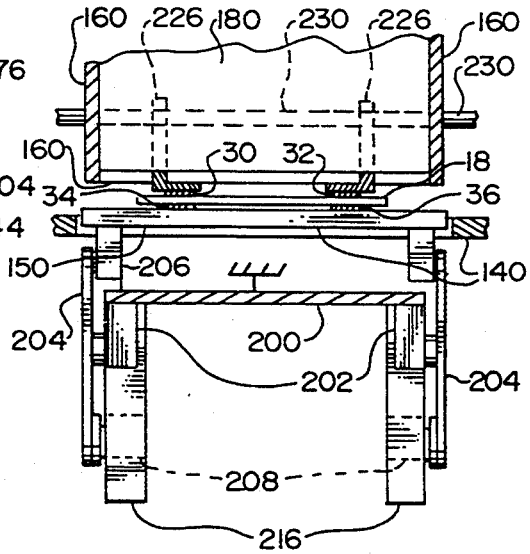
FIG. 5 is a cross-sectional view of a portion of the stabilization system taken along lines 5—5 in FIG. 3.

FIG. 5 illustrates a signature 18 in the position it occupies when being printed upon by the printer 180. The signature 18 is held in place between the belts 30, 32, 34, 36 a fixed distance below the bottom edge of the printer 180. The flat portions of the belt guides 156 are disposed on top of the belts 30, 32, and the belts 34, 36 are forced upwards against the underside of the signature 18 by the upwardly biased plate 150.

Referring to FIG. 1, in operation, a signature 18 which is conveyed by the moving chains 12, 14 is lifted from the chains 12, 14 by the lifting arms 142, 144. As the signature 18 is being lifted, the vertical members 20 of the lugs 16 continue to move the signature 18 forward (to the left in FIG. 1) until the signature 18 is captured between the belts 30, 32, 34, 36. The moving belts 30, 32, 34, 36 move the signature 18 past the underside of the printer 180, and the desired textual subject matter is printed on the signature 18. To determine when the signature 18 is in the position in which printing should start, a position sensor, such as a photoelectric eye, or other conventional sensing means could be utilized.

After the signature 18 is printed, the belts 30, 32, 34, 36 continue to move the signature 18 forward until the signature 18 is moved past the end of the support plate 140, at which point the signature 18 falls back onto the chains 12, 14 due to gravity. The speed at which the belts 30, 32, 34, 36 move can be synchronized to be at substantially the same speed at which the chains 12, 14 move so that, after it is printed, the signature 18 will fall back into the same conveyor space in the chains 12, 14 from which it was lifted by the lifting arms 142, 144.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A stabilization system for the printing of signatures, comprising:

first conveyor means for conveying a plurality of signatures in a longitudinal direction, said first conveyor means being subdivided into a plurality of conveyor spaces, one of said signatures being provided in each of said conveyor spaces of said first conveyor means;

first support means for supporting said first conveyor means;

lifting means for lifting said signatures off of said first conveyor means;

second conveyor means operationally coupled to said lifting means for conveying said signatures in said longitudinal direction;

second support means for supporting said second conveyor means, said second support means being separate and vibrationally isolated from said first conveyor means and said first support means; and printing means for printing textual subject matter on said signatures after said signatures are lifted from said first conveyor means by said lifting means, said printing means being separate and vibrationally isolated from said first conveyor means and said first support means.

2. A stabilization system as defined in claim 1 wherein said first conveyor means comprises a chain having a plurality of spaced lugs, the space between adjacent ones of said lugs defining a respective one of said conveyor spaces.

3. A stabilization system as defined in claim 1 wherein said second conveyor means comprises:

a first pair of conveyor belts spaced apart in a direction transverse to said longitudinal direction and provided in contact with an upper surface of one of said signatures; and a second pair of conveyor belts spaced apart in a direction transverse to said longitudinal direction and provided in contact with a lower surface of one of said signatures.

4. A stabilization system as defined in claim 1 additionally comprising means for returning said signatures to said first conveyor means after said textual subject matter is printed on said signatures.

5. A stabilization system as defined in claim 1 additionally comprising positioning means associated with said printing means for supporting a surface of each of said signatures at a fixed distance from said printing means.

6. A stabilization system as defined in claim 5 wherein said positioning means comprises a horizontal plate having an adjustable elevation.

7. A stabilization system as defined in claim 6 wherein said positioning means additionally comprises biasing means for spring-biasing said horizontal plate in a vertical direction towards said printing means.

8. A stabilization system as defined in claim 1 additionally comprising positioning means associated with said printing means for supporting a surface of each of said signatures at a fixed distance from said printing means, said positioning means comprising:

a pair of horizontal plates each having an adjustable elevation; and biasing means for spring-biasing said horizontal plates in a vertical direction towards said printing means.

9. A stabilization system as defined in claim 1 wherein said first support means comprises a first support table.

10. A stabilization system as defined in claim 1 wherein said second support means comprises a second support table.

11. A stabilization system as defined in claim 1, wherein said lifting means comprises a pair of spaced-apart, downwardly angled elements coupled to said second support table, each of said downwardly angled elements being provided on a different side of said first conveyor means, wherein said first conveyor means has an upper surface on which said signatures are conveyed, and wherein each of said downwardly angled elements has an end which lies below the elevation of said upper surface of said first conveyor means.

12. A stabilization system as defined in claim 1 wherein said printing means comprises:

a printer;

fixture means for mounting said printer; and adjustment means for adjusting the position of said fixture means in a direction transverse to said longitudinal direction.

13. A stabilization system as defined in claim 12 wherein said adjustment means comprises a pair of cylindrical slide rods provided for sliding engagement within a pair of bores each of which is associated with a respective side of said fixture means.

14. A stabilization system as defined in claim 1 wherein said first conveyor means conveys said signatures in said longitudinal direction at a first rate and wherein said second conveyor means conveys said signatures in said longitudinal direction at a second rate substantially equal to said first rate.

* * * * *